US010106959B2

(12) United States Patent
Bjerke et al.

(10) Patent No.: US 10,106,959 B2
(45) Date of Patent: Oct. 23, 2018

(54) ADAPTER SYSTEM FOR ATTACHING COMPONENTS TO DIFFERENTLY SIZED BASE EDGES

(71) Applicant: Caterpillar Inc., Peoria, IL (US)

(72) Inventors: Nathan Bjerke, Peoria, IL (US); Thomas Marshall Congdon, Dunlap, IL (US)

(73) Assignee: Caterpillar Inc., Deerfield, IL (US)

( * ) Notice: Subject to any disclaimer, the term of this patent is extended or adjusted under 35 U.S.C. 154(b) by 0 days.

(21) Appl. No.: 15/134,890

(22) Filed: Apr. 21, 2016

(65) Prior Publication Data

US 2017/0306591 A1 Oct. 26, 2017

(51) Int. Cl.
*E02F 9/28* (2006.01)

(52) U.S. Cl.
CPC ..... *E02F 9/2816* (2013.01); *E02F 9/2858* (2013.01); *E02F 9/2883* (2013.01)

(58) Field of Classification Search
CPC ..... E02F 9/2816; E02F 9/2858
See application file for complete search history.

(56) References Cited

U.S. PATENT DOCUMENTS

| | | | | |
|---|---|---|---|---|
| 1,193,511 A | | 8/1916 | Chambers | |
| 1,220,186 A | | 3/1917 | Chambers | |
| 1,519,101 A | * | 12/1924 | Armstrong | E02F 9/2816 279/102 |
| 2,073,801 A | * | 3/1937 | Linden | A01B 15/06 172/719 |
| 3,462,861 A | | 8/1969 | Kampert | |
| 3,496,657 A | | 2/1970 | Petersen | |
| 4,120,105 A | | 10/1978 | Caterpillar | |
| 5,960,571 A | * | 10/1999 | Perry | E02F 3/6481 198/813 |
| 7,337,564 B2 | | 3/2008 | Kimble | |
| 8,800,178 B2 | | 8/2014 | Metalogenia | |
| 9,428,874 B2 | * | 8/2016 | Winter | E01H 5/061 |
| 2014/0319257 A1 | | 10/2014 | Clemons | |
| 2014/0360060 A1 | | 12/2014 | Caterpillar | |
| 2015/0308076 A1 | | 10/2015 | Christenson | |
| 2016/0362873 A1 | * | 12/2016 | Campomanes | E02F 3/40 |

FOREIGN PATENT DOCUMENTS

| | | | | |
|---|---|---|---|---|
| GB 920825 A | * | 3/1963 | | E02F 9/28 |
| GB 920825 A | | 3/1963 | | |

* cited by examiner

*Primary Examiner* — Matthew D. Troutman
(74) *Attorney, Agent, or Firm* — Law Office of Kurt J. Fugman LLC

(57) ABSTRACT

A shim for use with a wear member comprises a body that defines a first aperture that includes a closed end and an open end, wherein the first aperture is defined by at least three surfaces including two side surfaces and at least one surface that defines the closed end and that further defines a surface normal that points toward the open end, and a second aperture that includes a closed end and an open end, wherein the second aperture is defined by at least three surfaces including two side surfaces and at least one surface that defines the closed end and that further defines a surface normal that points toward the open end. The surface normal of the first aperture forms an angle with the surface normal of the second aperture that is greater than zero degrees.

7 Claims, 8 Drawing Sheets

ADAPTER SYSTEM FOR ATTACHING COMPONENTS TO DIFFERENTLY SIZED BASE EDGES

TECHNICAL FIELD

The present disclosure relates to work tools such as excavating buckets and the like that have components such as wear members attached to their working edges. More specifically, the present disclosure relates to an adapter system that facilitates the attachment of wear members such as lip shrouds and the like to differently sized working edges such as base edges.

BACKGROUND

Work tools such as excavating buckets, shears, rake, etc. are commonly used by equipment and machinery in the construction and mining industries. These work tools such as excavating buckets have working edges that may contact work materials such as rock, stone, dirt, etc. that may cause the working edges to wear down over time, necessitating replacement of the working edge. For some work tools, this working edge may take the form of a base edge that forms part of the front lip of the bucket and that may be attached and detached using various methods such as welding, mechanical fastening systems. These base edges may themselves be protected by attaching wear members onto the base edge, covering the edge and protecting it from the wear caused by work material due to repeated motion and contact with the work material. The wear members may take on various forms including lip shrouds, tool adapters, tools, etc.

Different sized buckets are often used as needed for different sized machinery or equipment. It is typical for larger buckets to have a thicker base edge than the base edge used for smaller buckets. Due to the differing demand for different sized buckets, some accessories such as various types of wear members are available for the larger sized buckets but not for the smaller sized buckets due to a lack of cost justification. Users of the smaller sized buckets then are forced to forego the use of such wear members on their small sized buckets or to switch to a larger sized base edge that is compatible with a host of available accessories such as differently styled wear members.

However, the thicker sized base edge adds unnecessary weight to the smaller sized bucket that may be undesirable for a number of reasons including adversely affecting the balance of a smaller machine to which the bucket may be attached, requiring more power output by the motor of the machine, etc.

SUMMARY OF THE DISCLOSURE

A shim for use with a wear member is provided. The shim comprises a body that defines a first aperture that includes a closed end and an open end, wherein the first aperture is defined by at least three surfaces including two side surfaces and at least one surface that defines the closed end and that further defines a surface normal that points toward the open end, and a second aperture that includes a closed end and an open end, wherein the second aperture is defined by at least three surfaces including two side surfaces and at least one surface that defines the closed end and that further defines a surface normal that points toward the open end. The surface normal of the first aperture forms an angle with the surface normal of the second aperture that is greater than zero degrees.

An adapter system for attaching components to differently sized working edges of a work implement is provided. The system comprises a wear member including a first leg, a second leg, a throat portion that connects the legs together and that defines a sweep axis, and a nose that extends from the throat portion. At least one leg defines a surface that is configured to face toward a working edge and that includes a plurality of mounting pads that extend from the surface a predetermined height, forming a series of interconnected depressions between the mounting pads. The system further comprises a shim that includes a double H shaped configuration that is at least partially complimentary shaped to the series of interconnected depressions and that is configured to fit within the depressions.

DETAILED DESCRIPTION

Figure 1:
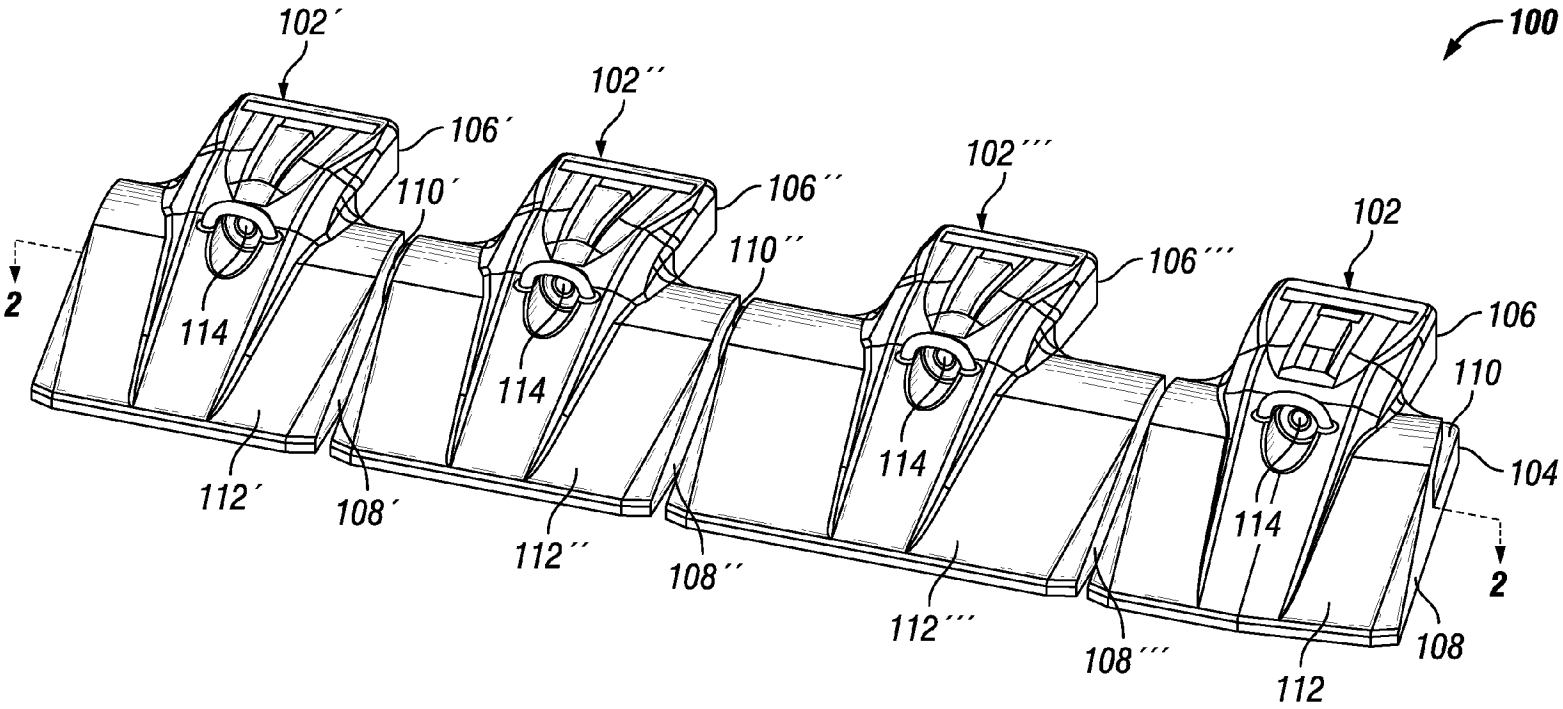
FIG. 1 is a perspective view of various wear members having different configurations shown side by side that use various embodiments of an adapter system of the present disclosure that facilitates the attachment of these wear members to differently sized base edges.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* or a prime indicator such as 100', 100" etc. It is to be understood that the use of letters or primes immediately after a reference number indicates that these features are similarly shaped and have similar function as is often the case when geometry is mirrored about a plane of symmetry. For ease of explanation in this specification, letters or primes will often not be included herein but may be shown in the drawings to indicate duplications of features discussed within this written specification.

An adapter system for attaching components such as a wear member onto a working edge of a work implement for use on construction or mining equipment or the like is provided. The system may include one or more shims that are configured to mate with features of one or more wear members that are configured to be attached to a working edge such as a base edge proximate the front lip of a bucket or the like. The shim or shims may include two or more planes of symmetry to help foolproof the assembly of the shim when used with a wear member and may be compatible with multiple wear members to save cost.

Looking at FIG. 1, a perspective view of various wear members having different configurations shown side by side is provided that use various embodiments of an adapter system of the present disclosure that facilitates the attachment of these wear members to differently sized base edges. As best seen for the embodiment shown to the extreme right in FIG. 1, the system 100 comprises a wear member 102 that includes a first leg 104, a second leg 106, and a throat portion 108 that connects the legs together, creating a slot 110 that is configured to allow the wear member 102 to straddle a base edge (not shown) or other type of working edge. A nose 112 extends from the throat portion 108 that is configured to provide protection of the base edge from work material such as dirt, rock, stone, etc. Each of the four wear members 102, 102', 102", 102'" has a slightly different configuration that allow different base edges and applications to be accommodated. For example, the three left wear members 102', 102", 102'" have different widths but all are intended to mate with a straight portion of a working edge. The rightmost wear member 102 is configured to mate with two different straight portions of a base edge that form an oblique angle with respect to each other as will be further explained momentarily. A mechanical attachment system 114 is provided for attaching the wear member to a base edge but it is contemplated that the wear members may be attached to a base edge using any attachment system that is known or that will be devised in the art. Other methods may be also used such as welding, etc.

As used herein, the term "wear member" is to be interpreted broadly to include any type of member that may be attached to a working edge of a work implement that provides some level of protection to that working edge from a work material such as dirt, rock, stone, etc. Examples of a "wear member" include, but are not limited to, tool adapters, tools, lip shrouds, etc. Such wear members may be made by any suitable process including casting, forging, machining, fabrication using formed sheets of material, etc. Similarly, such wear members may be made from any suitable material such as iron, etc. Similar materials and manufacturing techniques may be used for making the shims described herein.

Figure 2:
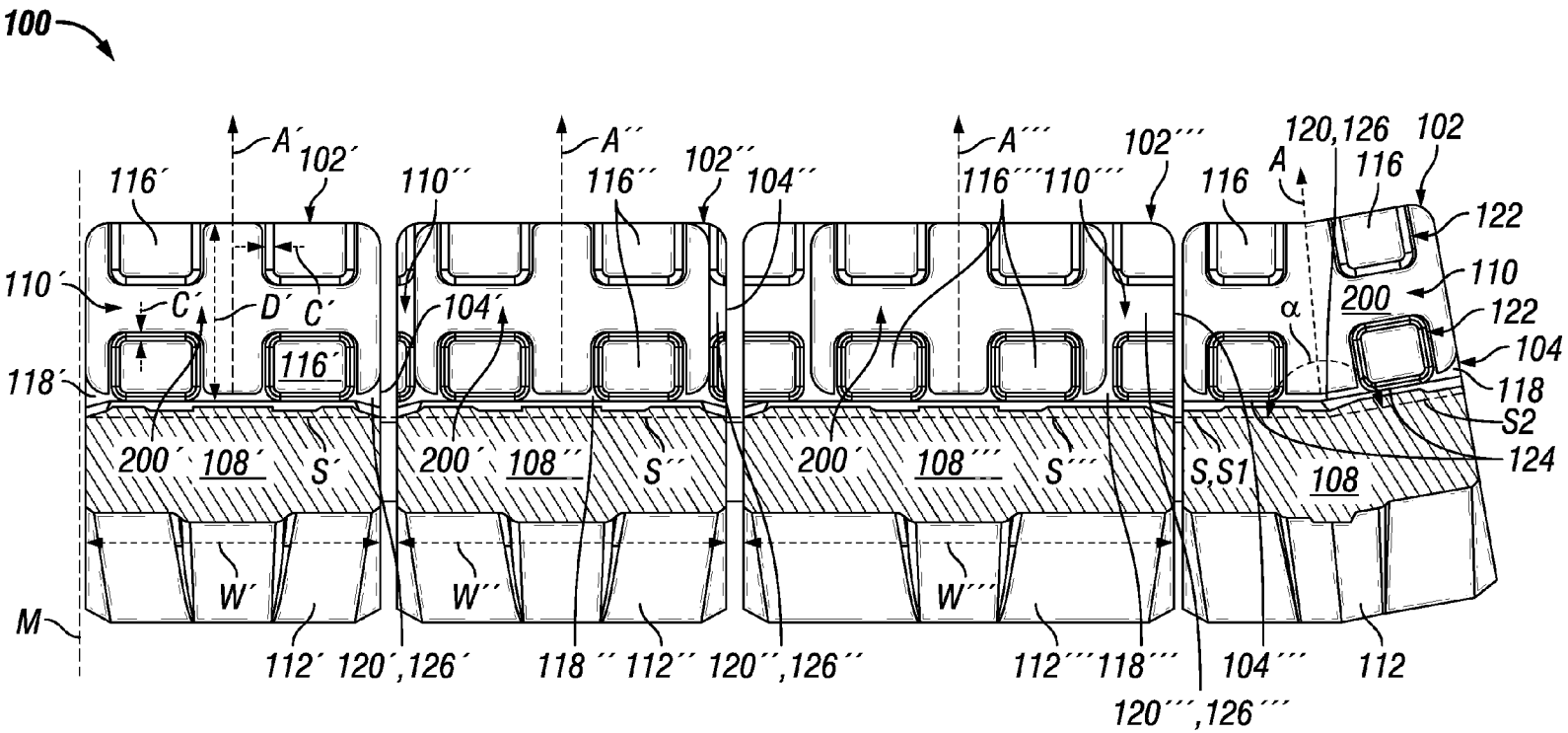
FIG. 2 is a cross-sectional view of the wear members and adapter systems of FIG. 1 taken along lines 2-2 thereof, showing shims that mate with the mounting pads disposed in the mounting slots of the wear members.

Turning now to FIG. 2, it shows a cross-sectional view of the wear members 102 and adapter systems 100 of FIG. 1 taken along lines 2-2 thereof, showing shims 200 that mate with the mounting pads 116 disposed in the mounting slots 110 of the wear members 102. This cross-section cuts through the throat portion 108, revealing that the throat portion 108 defines a sweep axis S that is essentially coincident with and matches the contour of the front edge (not shown) of the base edge. The mounting slot 110 extends in a direction substantially perpendicular to this sweep axis S, defining a direction A of assembly of the wear member 102 onto the base edge (see also FIGS. 3 and 4).

At least one leg 104 defines a surface 118 that is configured to face toward a working edge and that includes a plurality of mounting pads 116 that extend from the surface a predetermined height (see FIG. 4), forming a series of interconnected depressions 120 between the mounting pads 116. For the embodiments shown in FIG. 2, this leg with the mounting pads is the bottom leg but it is contemplated that in other embodiments that it could be the upper leg or both legs. A shim 200 is also provided that includes a double "H" shaped configuration that is at least partially complimentary shaped to the series of interconnected depressions 120, allowing the shim fit within the depressions 120 in-between the mounting pads 116. Single "H" shaped shims are also contemplated to be within the scope of the present disclosure as will be described in further detail later herein.

For all four embodiments of the wear member102 shown in FIG. 2, the mounting pads 116 form substantially a generally shaped rectangular array that includes rows 122 of mounting pads that are arranged parallel to the sweep axis S and columns 124 of mounting pads that are arranged perpendicular to the sweep axis S (see rightmost embodiment of wear member102). For the three embodiments shown from the left side of FIG. 2, the sweep axis S includes a straight portion that extends the entire width of the wear member. For the rightmost embodiment of the wear member shown in FIG. 2, the sweep axis S includes a first straight portion S1 and a second straight portion S2 that form an oblique angle $\alpha$ with respect to each other. This matches the corresponding oblique angle of the shim as will be described later herein.

As can be seen, the system 100 may comprise a plurality of similarly configured wear members 102 with similarly configured arrays of mounting pads 116 and interconnected depressions 120, wherein the plurality of similarly configured wear members 102 define widths W measured along their sweep axis S that are different from each other. The leftmost wear member 102' defines a width W' of 280 mm, the next wear member 102" to the right defines a width W" of 315 mm, and the next wear member 102'" to the right defines a width W'" of 405 mm. It should be noted that these dimensions and number of sizes are given by way of example only and that a different numbers of sizes such as one or two sizes and the actual dimensions that are varied may be different for various embodiments. In general terms, three different sizes may be provided that may be referred to as small, medium and large.

Looking at the leftmost wear member 102', it can be seen that the shim 200' is virtually an exact match for the configuration of the depressions. For the other two straight styled wear members 102", 102'", the same shim 200' fits into the depressions 120 formed by the mounting pads 116 of those wear members as well, although not entirely filling the depressions. Using a single shim that works with a plurality of wear members saves costs and makes using the system more easy as the user does not need to worry if they have the correct shim for a particular wear member provided the wear member has a particular style or configuration.

The rightmost wear member 102 in FIG. 2 has a different style or configuration, namely an angled configuration. Therefore, a differently configured shim 200 is provided. It is contemplated that this same shim could be used with similarly configured wear members having different widths. It is also contemplated that other styles of configurations for the wear members could be provided such as curved, staggered, etc.

For all the embodiments shown in FIG. 2, the depressions 120 define a surface area 126 that is projected onto the surface 118 of the leg that is configured to face toward a working edge, and the shim 200 is configured to cover the majority of the projected surface area of the depressions for each of the plurality of wear members. This helps provide stability between the base edge and the wear member as loads are transferred from the wear member through the shim to the base edge. Also, the shim 200 covers substantially the entire distance D from the rear edge of the wear member to the throat along the direction of assembly, helping to provide stability (see leftmost wear member 102'). This is achievable since the length of the leg with mounting pads measured along the direction of assembly from one embodiment to another is essentially the same. Some clearance C is provided between the edges or surfaces of the shim and the mounting pad, easing installation (again see the leftmost wear member 102' for an example).

FIG. 2 may be considered representative of the use of multiple wear member configurations that are used to cover half of a base edge. For example, the components shown in FIG. 2 could have counterparts that are mirrored about a midplane M shown at the left extremity of FIG. 2, creating a base edge that is entirely protected along its sweep axis. By mixing and matching the components of this system, various applications may be accommodated.

Figure 3:
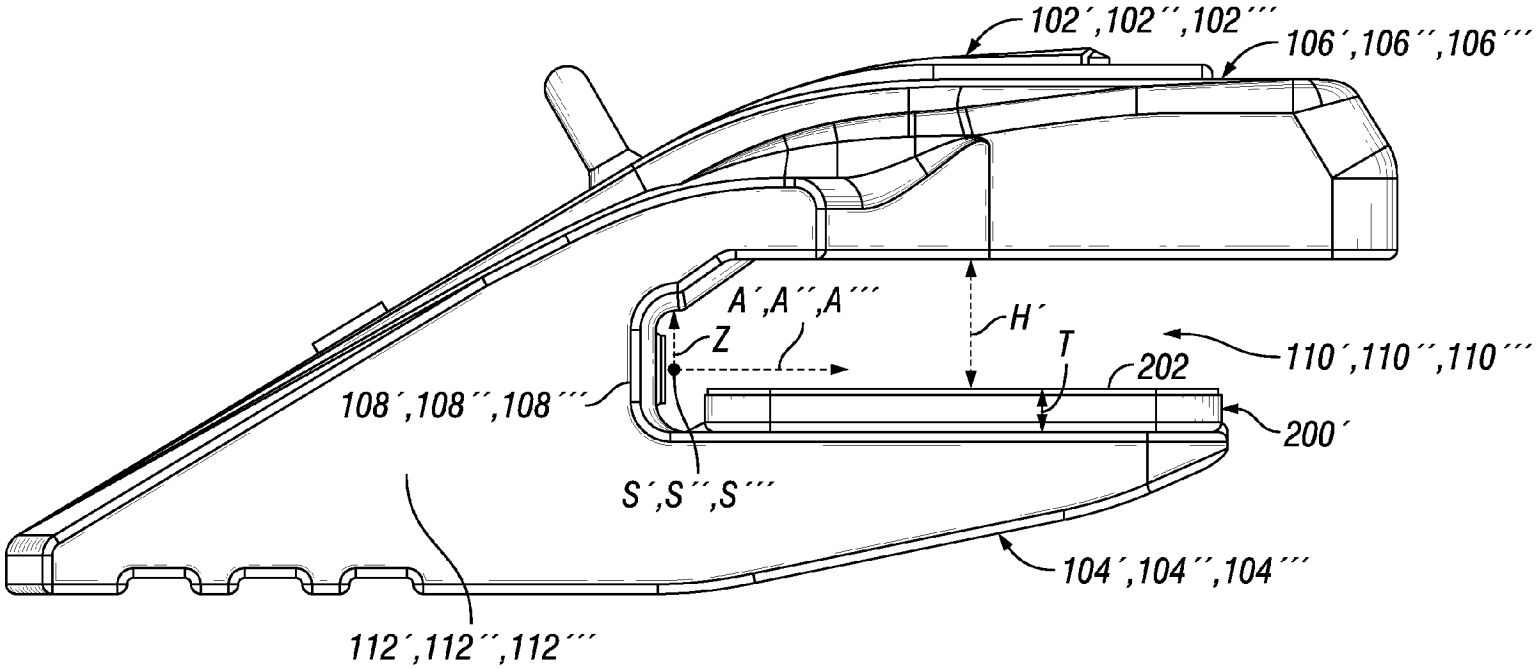
FIG. 3 is a side view of a wear member and an adapter system shown in FIG. 1 that uses a shim member to allow the wear member to be attached to a base edge having a smaller thickness than usual.
Figure 4:
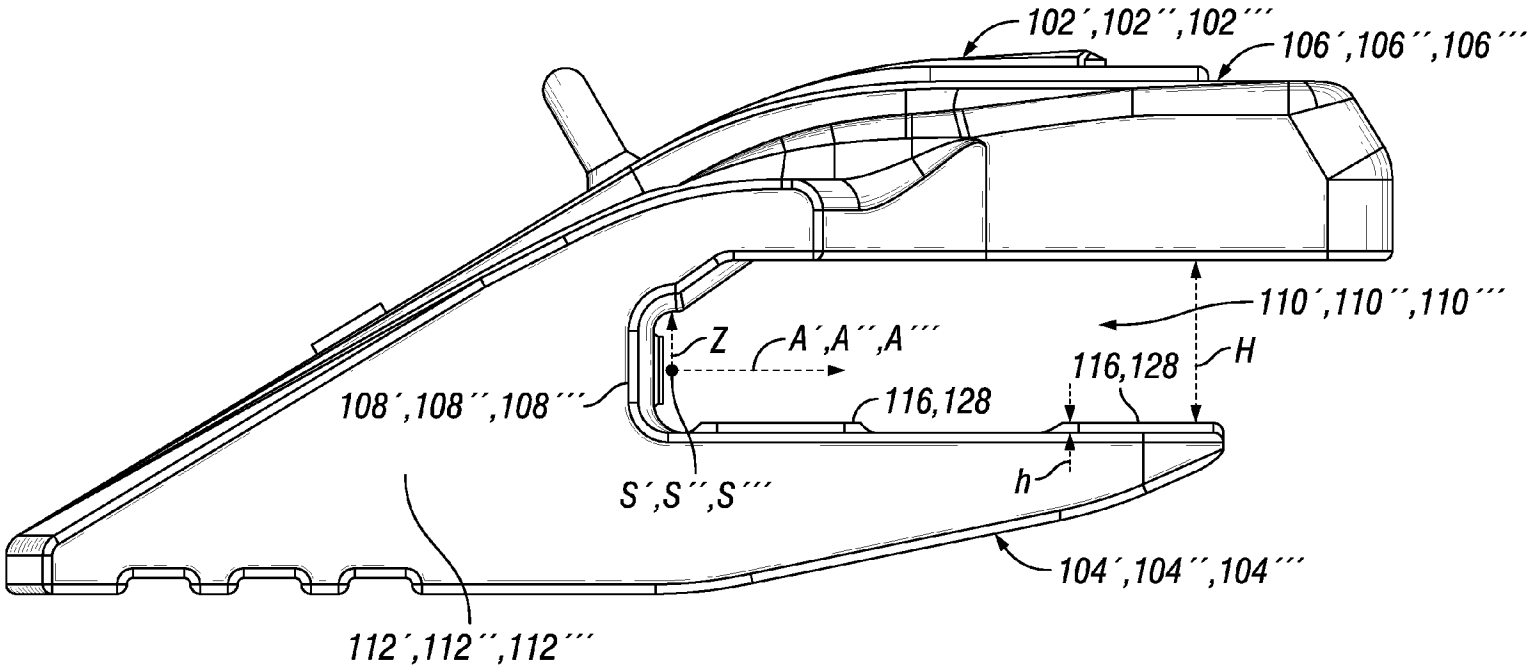
FIG. 4 is a side view of the wear member of FIG. 3 without the shim, allowing the wear member to be attached to a base edge having a larger thickness.

Looking at FIGS. 3 and 4 together, various features of the wear member 102', 102", 102'" can be seen more clearly than in FIG. 1. The wear member 102', 102", 102'" is shown to include a first leg 104', 104", 104'", a second leg 106', 106", 106'", and a throat portion 108', 108", 108'" that connects the legs together, creating a slot 110', 110", 110'" that is configured to allow the wear member to straddle a base edge or other type of working edge. A nose 112', 112", 112'" extends from the throat portion that is configured to provide protection of the base edge from work material such as dirt, rock, stone, etc. The mounting slot extends in a direction substantially perpendicular to this sweep axis S', S", S'", defining a direction A', A", A'" of assembly of the wear member onto the base edge. The general shape or profile of the wear member may be configured as needed or desired and may not look the same as what is shown in FIGS. 3 and 4.

FIG. 3 is a side view of a wear member 102', 102", 102'" and the shim 200'. As can be seen the shim 200' defines a thickness T that is the minimum dimension for the shim along a direction Z that is perpendicular to the sweep axis S and direction of assembly A and the thickness of the shim is greater than the height of the mounting pads. Consequently, it is the top surface 202 of the shim 200' that makes contact with a smaller sized base edge while it is the top surfaces 128 of the mounting pads 116 shown in FIG. 4 that make contact with the larger sized base edge. The height H of the slot from the top of the mounting pads in FIG. 4 to the top leg may be 51 mm, allowing it to mate with a base edge that is 50 mm thick. The height H' of the slot in FIG. 3 measured from the top surface of the shim to the top leg may be 41 mm, allowing it to mate with a base edge that is 40 mm thick. The height h of the mounting pads in FIG. 4 may be 3 mm and the thickness T of the shim in FIG. 3 may be 13 mm.

Again, it should be noted that these dimensions may be varied as desired and that different sized shims and base edges may be provided and/or accommodated. In general terms, there may be a thin and thick working edge that may be accommodated by using a shim. The thickness of the shim may be the difference between the thickness of the thick and thin base edges plus that of the mounting pads.

Figure 5:
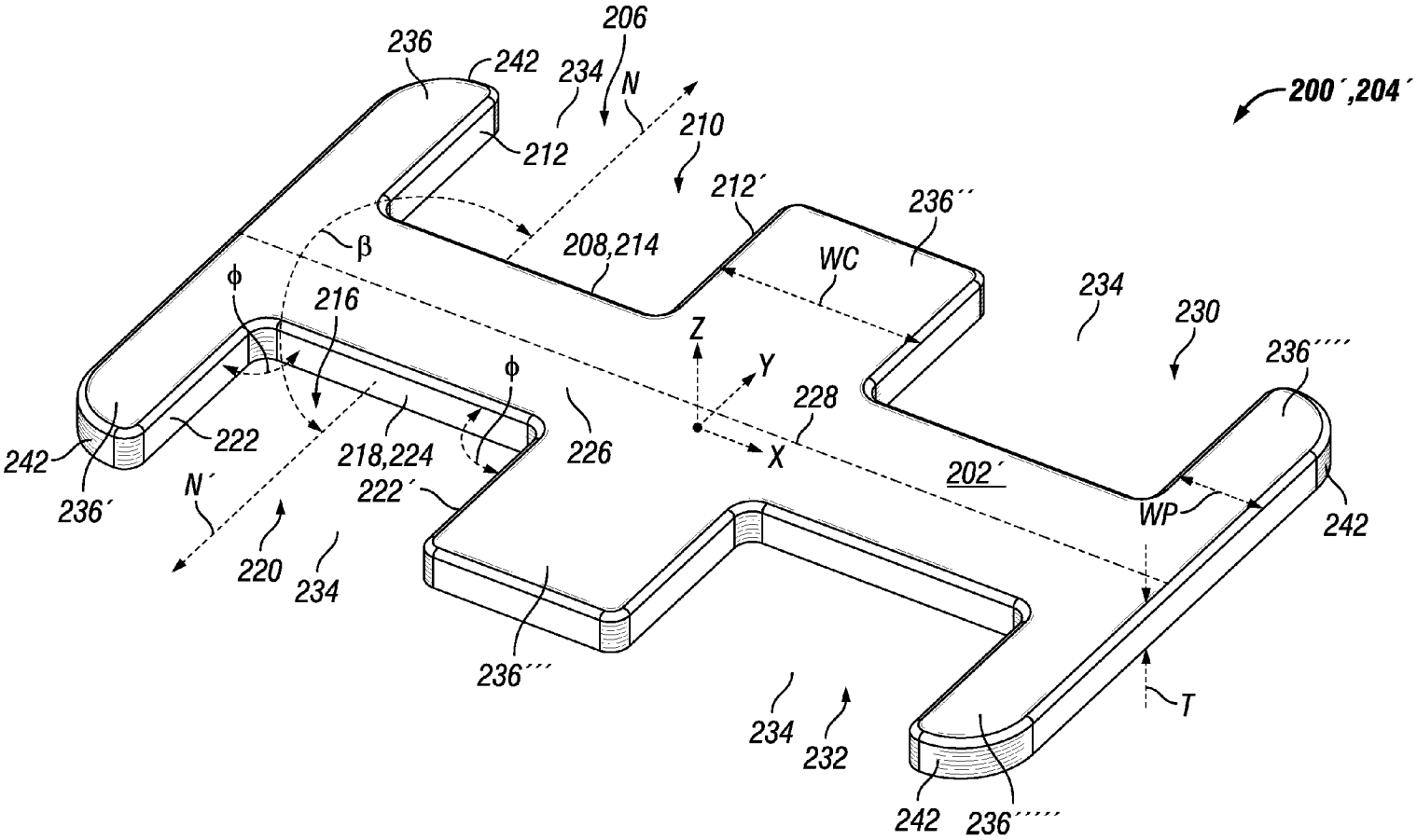
FIG. 5 is a perspective view of a shim according to one embodiment of the present disclosure that is compatible with differently sized wear members that are configured to be attached to a straight portion of a base edge.
Figure 6:
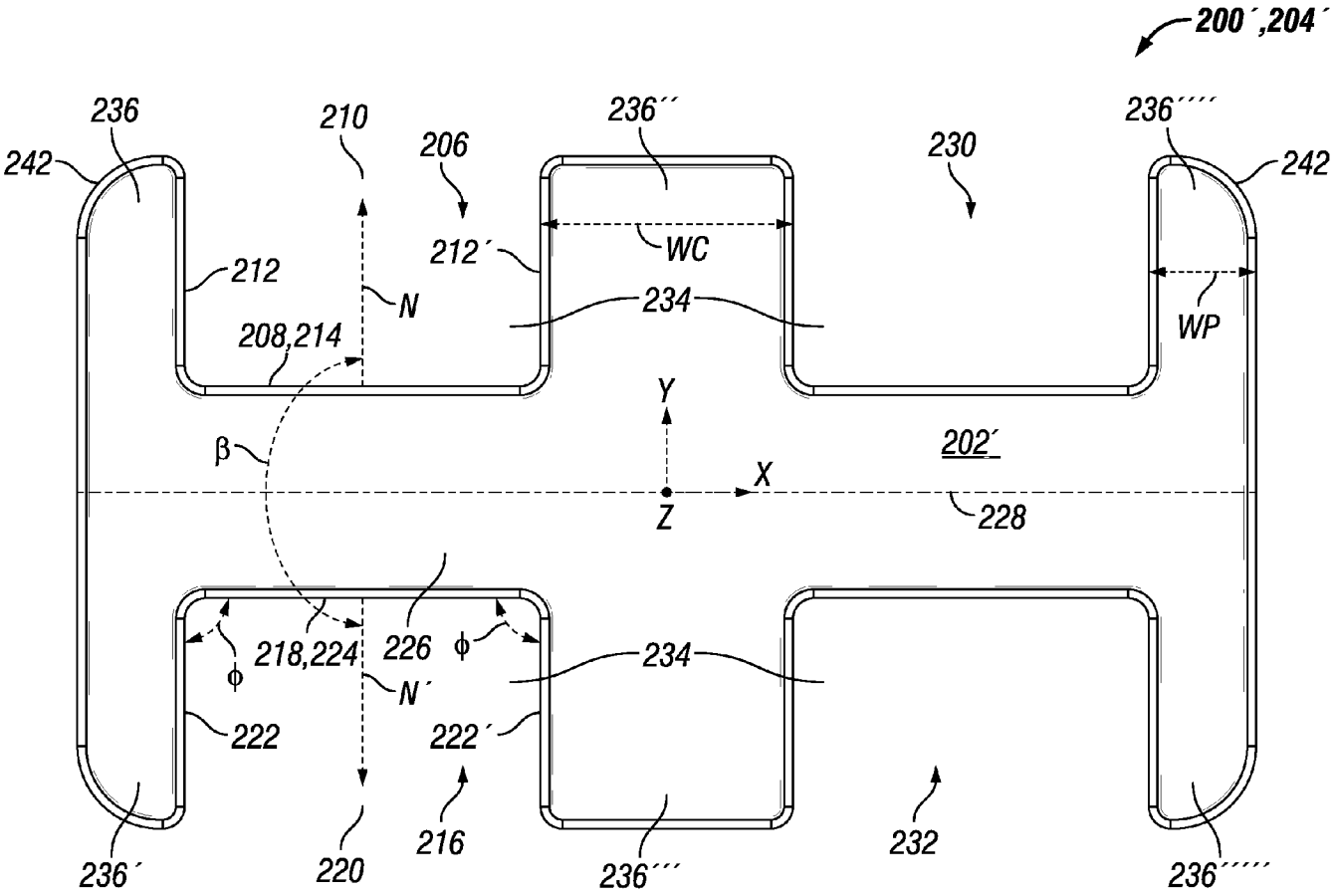
FIG. 6 is a top view of the shim of FIG. 5.

Focusing now on FIGS. 5 and 6, a shim 200' for use with a wear member as just described is shown in isolation from the wear member. The shim 200 comprises a body 204' that defines a first aperture 206 that includes a closed end 208 and an open end 210, wherein the first aperture 206 is defined by at least three surfaces including two side surfaces 212 and at least one surface 214 that defines the closed end 208 and that further defines a surface normal N that points toward the open end 210. The body 204 further defines a second aperture 216 that includes a closed end 218 and an open end 220, wherein the second aperture 216 is defined by at least three surfaces including two side surfaces 222 and at least one surface 224 that defines the closed end 218 and that further defines a surface normal N' that points toward the open end 220. The surface normal N of the first aperture 206 forms an angle β with the surface normal N' of the second aperture 216 measured on the top surface 202 that is greater than zero degrees. For the embodiment shown in FIGS. 5 and 6, the angle β is approximately 180 degrees but this could be varied as desired or needed.

Furthermore, at least one of the apertures 216 includes three straight or flat surfaces 222, 222', 224 that form angles φ with each other that are approximately ninety degrees but this may be varied as desired or needed. It is contemplated that any of these surfaces could be curved, etc. In this embodiment, the side surfaces 212 of the first aperture 206 are coplanar with the side surfaces 222 of the second aperture 216 but this may not be the case for other embodiments.

The body 204' of the shim 200' includes a spine portion 226 that is disposed between the apertures 206, 216 and that defines a sweep axis 228 for the body 204' of the shim 200' that mimics the sweep axis of the wear member (not shown in FIGS. 5 and 6). The body 204 of the shim defines a third aperture 230 that is similarly configured as the first aperture 206 and a fourth aperture 232 that is similarly configured as the second aperture 216 wherein the first aperture 206 is disposed on the same side of the spine portion 226 as the third aperture 230 and the second aperture 216 is disposed on the same side of the spine portion 226 as the fourth aperture 232. The third and fourth apertures are spaced away from the first and second apertures the same distance along the sweep axis 228 that is straight, forming a rectangular array 234.

The body 204' of the shim 200' further comprises a plurality of projections 236 that extend from the spine portion 226, defining the side surfaces 212, 222 of the apertures. A Cartesian coordinate system is provided at the centroid (center of mass) of the shim. It can be seen that the body forms a substantially double H shaped configuration that is symmetrical about the X-Y, Y-Z and X-Z planes. This fool proofs the assembly of the shim with the wear member. It is contemplated that half of the shim may be provided for other embodiments where it is cut in half along the Y-Z plane. In such an embodiment, the shim would have an "H" configuration. Also, the body 204 defines a thickness T that is the minimum dimension of the body and at least one aperture 206 ends completely through the thickness. It is contemplated that the apertures may be blind in the Z direction in other embodiments.

Figure 7:
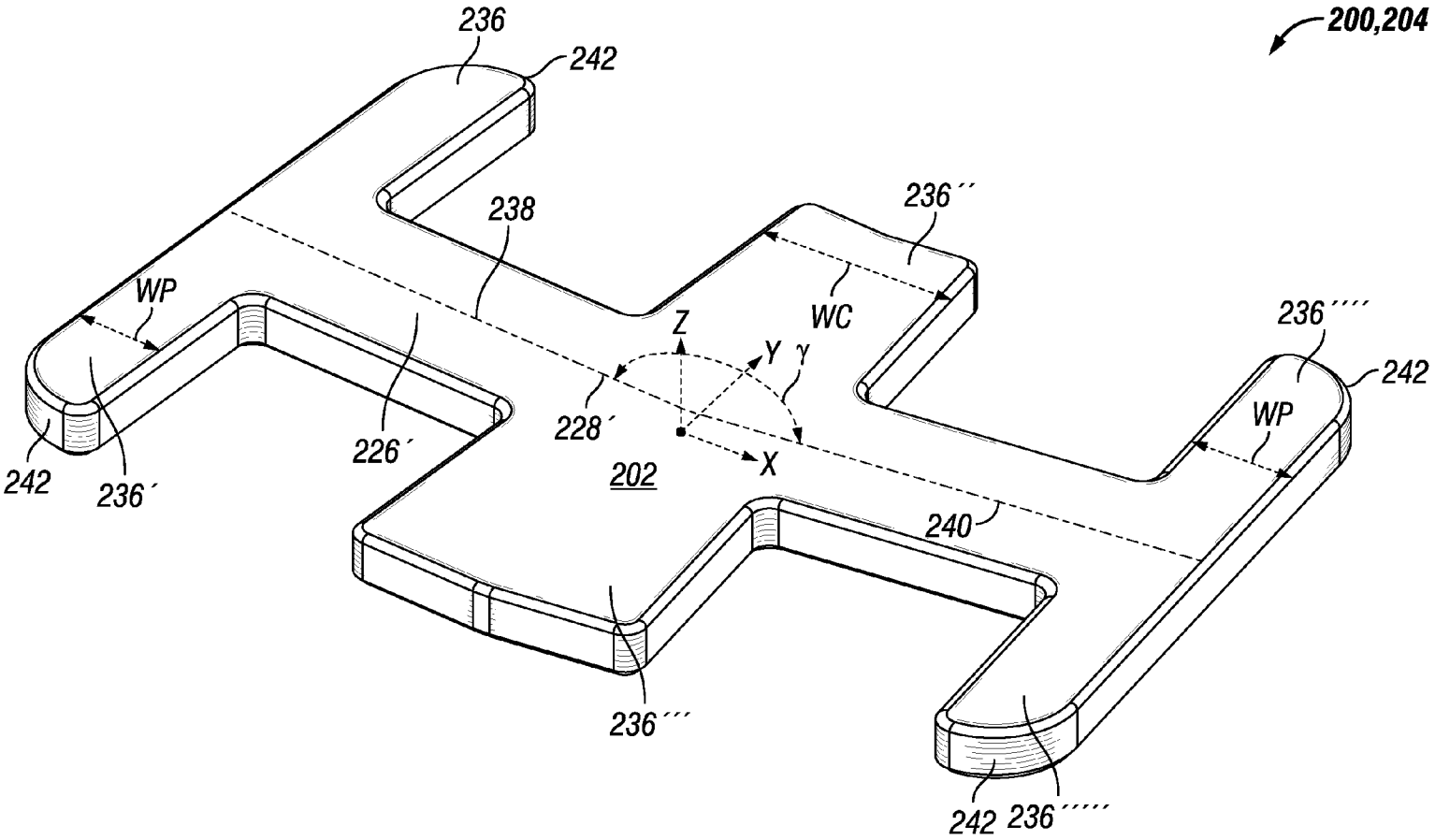
FIG. 7 is a perspective view of a shim according to another embodiment of the present disclosure that is compatible with a wear member that is configured to be attached to a transitional portion of a base edge where the front edge transitions from straight to angled.
Figure 8:
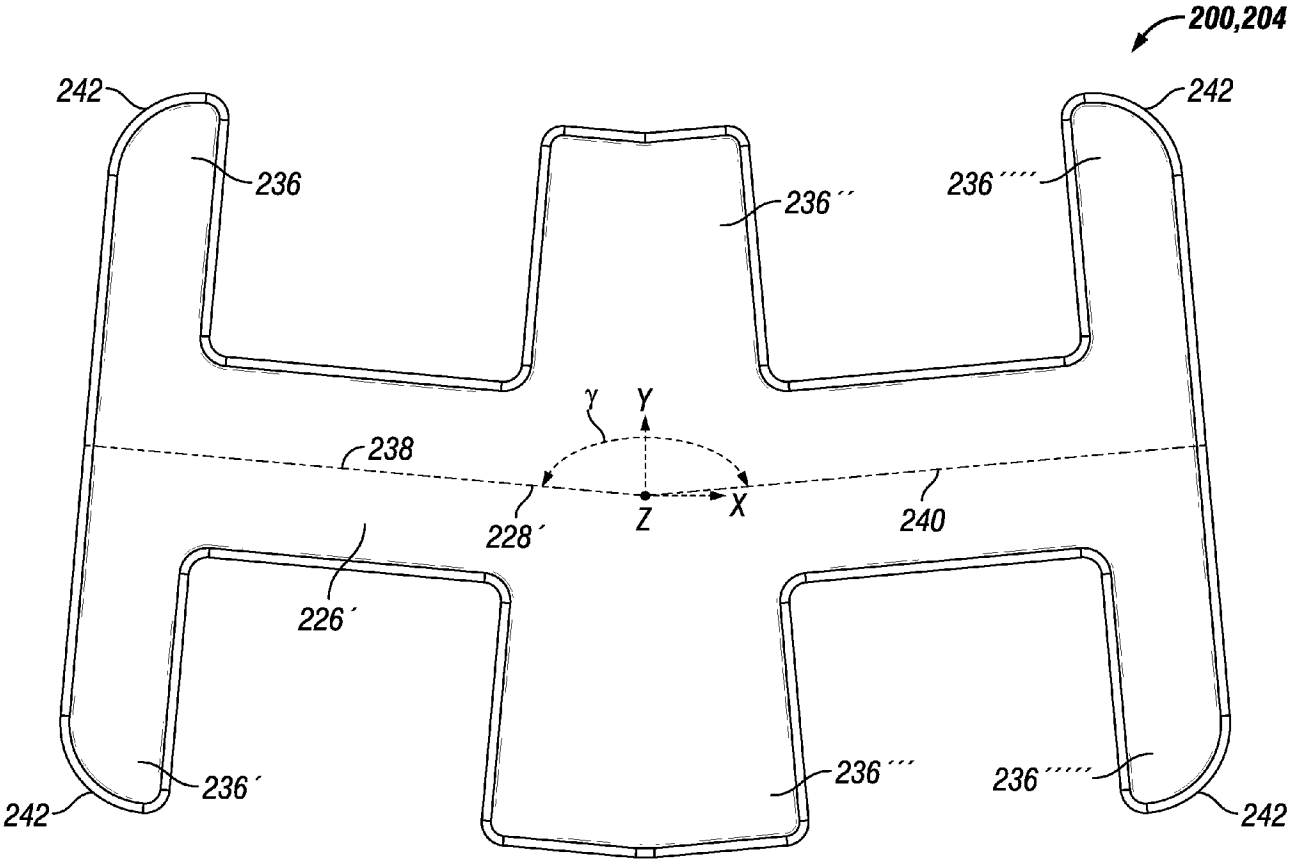
FIG. 8 is a top view of the shim of FIG. 7.

The shim 200 of FIGS. 7 and 8 is similarly configured as that of FIGS. 5 and 6 except that the spine 226' changes direction along the sweep axis 228' that also changes direction. More specifically, the sweep axis 228' comprises a first straight portion 238 and a second straight portion 240 that forms an oblique angle γ on the top surface 202 with the first straight portion 238. The oblique angle γ may be approximately 170 degrees but may be varied as needed or desired. A Cartesian coordinate system is also provided for this shim at its centroid. This shim is only symmetrical about the Y-Z and X-Y planes.

It should be noted that all the outer projections 236, 236', 236'", 236'"' of FIGS. 5 thru 8 define a generous radius 242 that is intended to match a corresponding radius of a wear member. Also, the width WP of the outer projections is less than the width WC of the center projections measured along the sweep axis 228'. These features allow the shims to fit exactly on the leg of the wear member without extending past the leg, helping to protect the shim from damage (see leftmost and rightmost embodiments shown in FIG. 2).

INDUSTRIAL APPLICABILITY

In practice, an adapter system for attaching components such as a wear member onto a working edge of a work implement for use on construction or mining equipment or the like may be provided by selling, buying, or making the adapter system. The system may include one or more shims that are configured to mate with features of one or more wear members that are configured to be attached to a working edge such as a base edge proximate the front lip of a bucket or the like. The shim or shims may include two or more planes of symmetry to help foolproof the assembly of the shim when used with a wear member and may be compatible with multiple wear members to save cost. The shims and wear members may be provided separately or together. They also may be attached to a work implement that is sold.

The various embodiments of the apparatus described herein may be use with a method of assembly as will now be described. A suitable base edge may be provided and attached to a work implement. A wear member may then be attached to the work implement after an appropriate shim has been inserted into the mounting slot of the wear member. Usually, the shim is inserted in-between the mounting pads and into depressions found therebetween, helping to keep the shim in place as the wear member and shim are mounted onto the base edge. Additional wear members and shims may then be attached to the base edge as needed or desired. In some applications, an undesirable base edge may already be attached to the work implement such as a base edge or other working edge that is too big and/or heavy. In such a case, the base edge may be removed and a different base edge may be attached to the work implement. The steps of attaching the wear members with shims may then be accomplished.

While most embodiments have been directed to the lip shrouds that are attached to the base edge of a bucket, the principles of the disclosed embodiments and methods may be equally applied to other applications that involve any wear member that may be attached to any working edge of any work implement. Similarly, the configurations, materials, and methods of manufacturing may be altered as needed or desired.

It will be appreciated that the foregoing description provides examples of the disclosed assembly and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. An adapter system for attaching components to differently sized working edges of a work implement, the system comprising:

a wear member including:

a first leg;

a second leg;

a throat portion that connects the legs together and that defines a sweep axis; and a nose that extends from the throat portion;

wherein at least one leg defines a surface that is configured to face toward a working edge and that includes a plurality of mounting pads that extend from the surface a predetermined height, forming a series of interconnected depressions between the mounting pads; and a shim that includes a double H shaped configuration that is at least partially complimentary shaped to the series of interconnected depressions and that is configured to fit within the depressions.

2. The system of claim 1 wherein the mounting pads form a generally configured rectangular array that includes rows of mounting pads that are arranged parallel to the sweep axis and columns of mounting pads that are arranged perpendicular to the sweep axis.

3. The system of claim 2 wherein the sweep axis includes a straight portion.

4. The system of claim 3 further comprising a plurality of similarly configured wear members with similarly configured arrays of mounting pads and interconnected depressions, wherein the plurality of similarly configured wear member define widths measured along their sweep axis that are different from each other.

5. The system of claim 4 wherein the same shim fits into the depressions formed by the mounting pads of the plurality of wear members.

6. The system of claim 5 wherein the depressions define a surface area that is projected onto the surface of the leg that is configured to face toward a working edge, and the shim is configured to cover the majority of the projected surface area of the depressions for each of the plurality of wear members.

7. The system of claim 1, wherein the shim defines a thickness that is the minimum dimension for the shim and the thickness of the shim is greater than the height of the mounting pads.

* * * * *